United States Patent [19]

Meulemans et al.

[11] 4,307,315

[45] Dec. 22, 1981

[54] HIGH PRESSURE DISCHARGE LAMP WITH VESSEL HAVING A UV RADIATION ABSORBING PORTION OF QUARTZ GLASS

[75] Inventors: Charles C. E. Meulemans; Gerardus H. A. M. van der Steen; Jan van Werkhoven, all of Eindhoven, Netherlands

[73] Assignee: U.S. Philips Corporation, New York, N.Y.

[21] Appl. No.: 971,752

[22] Filed: Dec. 21, 1978

[30] Foreign Application Priority Data

Dec. 23, 1977 [NL] Netherlands ..... 7714305

[51] Int. Cl.[3] ..... H01J 5/04; H01J 61/30

[52] U.S. Cl. ..... 313/44; 313/112; 313/221

[58] Field of Search ..... 313/112, 221, 44

[56] References Cited

U.S. PATENT DOCUMENTS

| | | | |
|---|---|---|---|
| 2,291,952 | 8/1942 | Dench | 313/184 X |
| 2,326,773 | 8/1943 | Floyd | 313/112 X |
| 2,434,980 | 1/1948 | Bilofsky | 313/112 X |
| 3,451,579 | 6/1969 | Bishop | 313/218 X |
| 3,848,152 | 11/1974 | Schultz | 313/112 X |
| 3,851,200 | 11/1974 | Thomasson | 313/221 X |
| 3,900,750 | 8/1975 | Bamberg et al. | 313/44 |
| 3,963,951 | 6/1976 | Bamberg | 313/44 |

*Primary Examiner*—Palmer C. Demeo
*Attorney, Agent, or Firm*—Robert S. Smith

[57] ABSTRACT

High-pressure discharge lamp according to the invention have a quartz glass lamp vessel (1) which consists locally of UV-absorbing quartz glass (shaded region 2). During operation of the lamps the normally colder wall parts of the lamp vessel in this region thus assume a higher temperature, as a result of which the efficiency of the lamp is increased while said regions (2) nevertheless remain transparent to visible radiation.

5 Claims, 8 Drawing Figures

Figure 1:
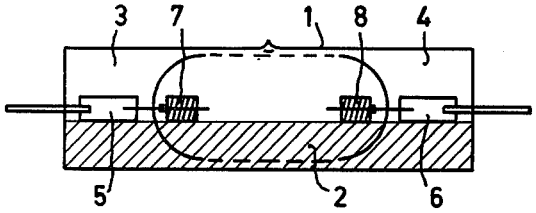

HIGH PRESSURE DISCHARGE LAMP WITH VESSEL HAVING A UV RADIATION ABSORBING PORTION OF QUARTZ GLASS

The invention relates to a high-pressure discharge lamp of the type having a tubular, vacuum-tight sealed quartz glass lamp vessel. In the wall of which the vessel supply conductors extend to a pair of electrodes arranged inside the lamp vessel. The lamp vessel has an ionizable gas filling and means to locally increase the temperature of one or more regions of the lamp vessel during operation.

Such lamps are known. According to U.S. Pat. No. 3,851,200 the lamp vessel is covered at one end with zirconium oxide so as to reflect light and heat. U.S. Pat. No. 3,963,951 discloses a lamp for use in the horizontal position, a heat-reflecting coating being provided at the ends around and over the whole length on the lower side of the lamp vessel.

The object of such a local coating is to increase the vapor pressure of the gas filling by raising the temperature of the wall of the lamp vessel at that area and hence to improve the efficiency of the lamp. It is known inter alia from U.S. Pat. No. 2,291,952 to provide metal shields around the ends of the lamp vessel for that same purpose.

The disadvantage of the use of a coating is that during its manufacture the lamp must be subjected to an extra treatment and that the coating is thin, as compared with the wall of the lamp vessel, and hence has a restricted heat-reflecting capacity. In themselves, shields give a good heat reflection but require provisions to secure them to the lamp vessel. Shields and coatings have the disadvantage of retaining not only heat radiation but also visible radiation.

It is the object of the invention to provide means to locally increase the wall temperature of a region of a lamp vessel during operation and thus to obtain a more uniform temperature over the lamp vessel, while the lamp vessel nevertheless remains light-pervious at that region.

In agreement herewith the invention relates to a high-pressure discharge lamp of the type defined in the preamble which is characterized in that the lamp vessel consists solely within said region(s) of ultraviolet radiation-absorbing quartz glass which is transparent to visible radiation.

Quartz glass is to be understood to mean herein glass having an $SiO_2$ content of at least 95% by weight.

Ultraviolet (UV) radiation-absorbing quartz glass is known per se, see inter alia Russian Patent Specification No. 216,189, which describes quartz glass having 0.1–2% by weight of europium, and Chem. Abstr. 79 98813 w (1973) and 83 68308a (1975).

The use of ultraviolet radiation-absorbing quartz glass to form therefrom parts of the lamp vessel has important advantages. Also since the walls of a lamp vessel are comparatively thick—order of magnitude 1 mm—it gives an effective absorption of UV radiation and hence a larger rise in temperature, while it nevertheless is transparent. There is hence no objection to the manufacture of large parts of the lamp vessel, for example, the whole lower side of a lamp operating in the horizontal position, from this quartz glass.

The large rise in temperature to which normally cold places are subject permits the lamp vessel to have a larger volume. As a result of this the hottest places are not superheated, while the coldest places remain sufficiently warm due to the use of UV-absorbing quartz at that region. Said increase in volume involves a better maintenance of the luminous efficiency during the life of the lamp, since metal evaporated from the electrodes is now spread as a thinner film over a larger lamp vessel area. Further, the hottest parts of the lamp vessel are subject to lower maximum temperatures (due to the increased vessel size) so that the attack of the quartz glass by radicals or ions from the gas filling is reduced.

It is to be noted that it is known, for example from U.S. Pat. No. 3,848,152, to give high-pressure discharge lamps a lamp vessel entirely of UV-radiation-absorbing quartz glass. The object of this is to prevent the detrimental effect of UV radiation on the human eye. Since in a lamp according to the invention the lamp vessel consists only locally of UV-absorbing quartz glass, this object is neither sought nor achieved in a lamp according to the invention. In many cases, high-pressure discharge lamps already comprise means which prevent the radiation of UV, for example, a glass outer envelope; in other cases the lamps are operated in closed luminaires which prevent the radiation of UV.

On the other hand the object of the invention—producing a local increase of the temperature of a lamp vessel—is not achieved by using UV-absorbing quartz for the manufacture of the whole lamp vessel. The parts of the lamp vessel which when normal quartz glass is used are hottest, would become even hotter when UV-absorbing quartz glass is used for the whole lamp vessel and would approach the softening point of the glass too closely. Therefore the lamp vessel would have to be chosen to be wider, as a result of which, however, the temperature of the colder parts would also be reduced. A more uniform temperature of the lamp vessel is not realized in this manner.

The physical construction of the lamp and its destined operating position determine, in high-pressure discharge lamps, the regions of the lamp vessel at which coatings or shields can advantageously be provided or, in lamps according to the invention, the regions of the lamp vessel which should consist of UV-absorbing quartz glass. The invention may be used in high-pressure mercury vapor lamps, in particular in such lamps having halide additions. The measure according to the invention results in higher lm/W values.

In a first embodiment, one end of the lamp vessel up to the remote end of the associated electrode consists of UV-absorbing quartz glass. The lamp is destined for operation in a vertical position with the said one end of the lamp vessel of UV-absorbing quartz glass lowermost.

In a modified embodiment of a lamp destined for operation in a vertical position, in which an electrode is arranged at each end of the lamp vessel, the UV absorbing quartz glass further extends from said one end to along a part of the space between the electrodes.

If the lamp vessel consists at either end of UV-absorbing quartz glass, the lamp may be arranged arbitrarily axially in an outer envelope.

In lamps destined for operation in a horizontal position the lamp vessel consists of UV-absorbing quartz glass over a part, for example a third or half of its circumference, over its whole length. In a modified embodiment thereof the remaining wall parts of the lamp vessel which surround the electrodes are also UV-absorbing.

Starting material for the manufacture of lamp vessels for high-pressure discharge lamps generally is tubular glass. In high-pressure mercury vapour discharge lamps comprising metal halide additions the lamp vessel often has a smaller diameter at its ends than towards its center. Such lamp vessels are made by sealing a tube having a smaller diameter to each end of a piece of quartz glass tube having a larger diameter. For the manufacture of lamps according to the invention in that case to one or to both ends of a piece of quarter glass tube a tube of UV-absorbing quartz glass is sealed.

Other lamp vessels according to the invention in which the wall is UV-absorbing over a part of the circumference but over the whole of the length of the lamp vessel can be manufactured from corresponding tubular glass.

Figure 6:
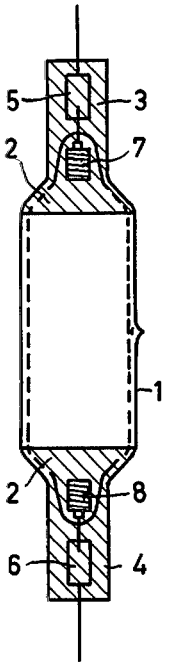
Figure 7:
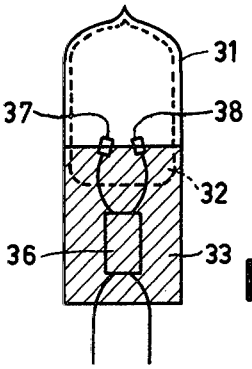
Figure 8:
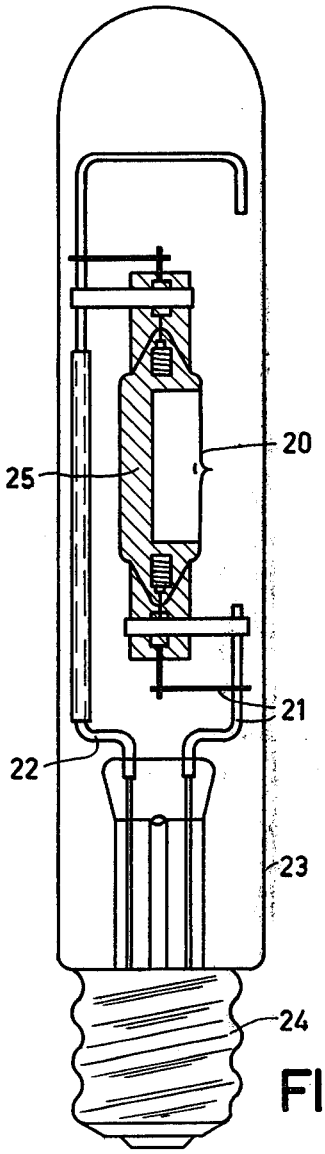

Embodiments of the invention will now be described in greater detail with reference to the Examples of the accompanying drawings, in which FIGS. 1 to 7 are elevations of various discharge lamps in accordance with the invention and FIG. 8 is an elevation of a discharge lamp arranged in an outer envelope.

In FIGS. 2 to 7, the same reference numerals are used for corresponding components and the regions comprising UV-absorbing glass are shown shaded.

The lamp vessel of a high-pressure mercury vapor discharge lamp shown in FIG. 1 comprises a part 1 of UV-permeable quartz glass and a part 2 of UV-absorbing quartz glass. The lamp vessel has seals 3 and 4, respectively, at each end around current conductor 5 and 6, respectively. Electrodes 7 and 8 are arranged in the lamp vessel. The lamp is destined for operation in a horizontal position.

Figure 2:
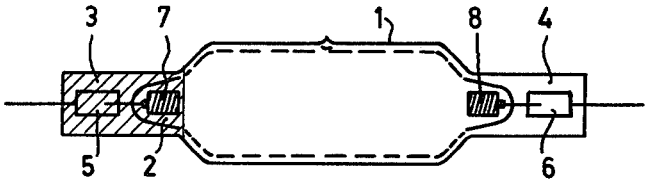

FIG. 2 shows a high-pressure mercury vapor discharge lamp with metal halide additions, particularly suitable for operation in a vertical position with the seal 3 lowermost. The seals 3 and 4 are each made in a piece of tubular glass of a smaller diameter sealed to a piece of glass of a larger diameter.

Figure 3:
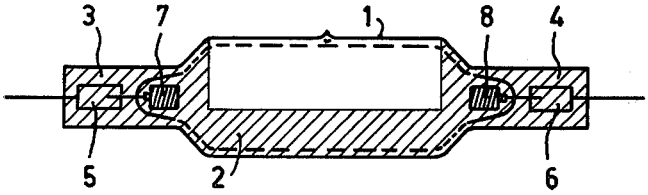

FIG. 3 shows a lamp which is a modified embodiment of the lamp shown in FIG. 2 and is destined for operation in a horizontal position with the non-UV-absorbing quartz glass uppermost.

Figure 4:
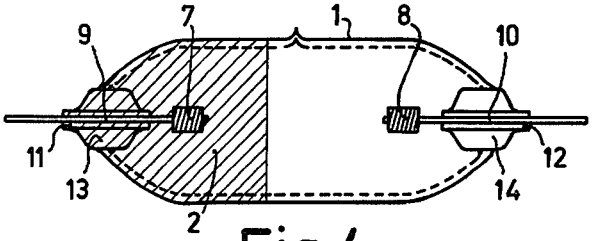

FIG. 4 shows a high-pressure mercury vapor discharge lamp for operation in a vertical position with part 2 lowermost. At its ends the lamp vessel is sealed in a vacuum-tight manner around current supply conductors 9 and 10. They each have first quartz glass envelopes 11 and 12, respectively, and second quartz glass envelopes 13 and 14, respectively, to which the wall of the lamp vessel is sealed.

Figure 5:
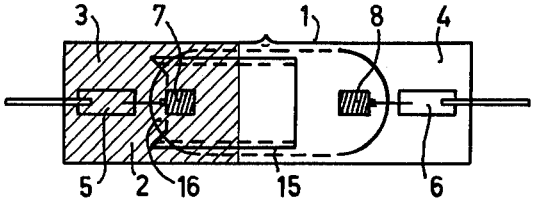

In FIG. 5 the lamp vessel 1 has an inner tube 15 which is locally sealed to the seal 3 of the lamp vessel but elsewhere leaves apertures 16. The object of the tube 15 is to prevent demixing (separation) of the gas in the lamp during operation.

The lamp shown in FIG. 6 is destined for operation in a vertical position. The lamp can be operated in the position shown, but also with pinch seal 4. Uppermost to these is a larger freedom when assembling the lamp in an outer envelope.

In FIG. 7 the lamp with quartz glass lamp vessel 31 has only one pinch seal 33. The current supply conductors, only one (36) of which is visible, to the electrodes 37 and 38 are sealed in said pinch seal. The current supply conductors with interposed insulator are present as a stack in the pinch seal. The sealed part 32 of the lamp vessel 31 consists of U.V. absorbing quartz glass.

In FIG. 8, a lamp vessel 20 corresponding to FIG. 3 is arranged between pole wires 21 and 22 in an outer envelope 23 having a lamp cap 24. Because the part 25 of the lamp vessel 20 facing the pole wire 22 consists of UV-absorbing quartz glass the conventional ceramic envelope of said pole wire may be omitted. By using the absorbing quartz glass, photo-emission is controlled already efficaciously.

EXAMPLE

A lamp as shown in FIG. 6 was filled with the following substances: 50 mg of mercury, 0.8 mg of $HgI_2$, 3.7 mg TlI, 30 mg of NaI, 0.2 mg of In and Ar containing $Kr^{85}$ in a quantity of 0.01 mC/l (at 1 atm.) to 30 mbar. The lamp had the following dimensions: volume 11 ml, largest inside diameter 20 mm, electrode spacing 46 mm, length of the non-UV-absorbing part of the lamp vessel 34 mm.

With a consumed power of 400, 500 and 600 W, respectively, the lamp had an efficiency of 96.4, 105.5 and 111.7 lm/W, respectively.

For comparison, a lamp was manufactured having the same dimensions and the same gas filling, but entirely of quartz glass. The parts which in the lamp shown in FIG. 6 consisted of UV-absorbing quartz glass, were covered with $ZrO_2$ in this lamp, the lamp gave an efficiency of 85 lm/W with a consumed power of 400 W.

What is claimed is:

1. A high-pressure discharge lamp having a tubular, vacuum-tight sealed quartz glass lamp vessel, a pair of electrodes disposed in said vessel, current supply conductors extending through the wall of said vessel to said pair of electrodes, said lamp vessel having an ionizable gas filling and means to locally increase the temperature of one or more regions of the lamp vessel during operation, said lamp vessel having at least one region which consists solely of ultraviolet radiation-absorbing quartz glass, which is transparent to visible radiation, the remainder of said vessel being composed of a different quartz material which is ultraviolet radiation transmitting.

2. A high-pressure discharge lamp as claimed in claim 1, characterized in that one end of the lamp vessel consists of UV-absorbing quartz glass up to the remote end of the associated electrode.

3. A high-pressure discharge lamp as claimed in claim 2, in which at each of the ends of the lamp vessel a current conductor to an electrode arranged near the respective end is sealed, characterized in that the UV-absorbing quartz glass further extends along a part of the space between the electrodes.

4. A high-pressure discharge lamp as claimed in claim 2, in which at each of the ends of the lamp vessel a current conductor to an electrode arranged near the respective end is sealed, characterized in that the other end of the lamp vessel similarly consists of UV-absorbing quartz glass.

5. A high-pressure discharge lamp as claimed in claim 1, characterized in that the lamp vessel consists of UV-absorbing quartz glass solely for a part of its circumference over its whole length.

* * * * *